US006220250B1

(12) United States Patent
Park

(10) Patent No.: US 6,220,250 B1
(45) Date of Patent: Apr. 24, 2001

(54) ARTIFICIAL FINGERNAIL ATTACHMENT AID

(76) Inventor: Jong Ho Park, #252 Hyuikyoung-dong, Dongdaemoon-gu, Seoul (KR)

( * ) Notice: Subject to any disclaimer, the term of this patent is extended or adjusted under 35 U.S.C. 154(b) by 0 days.

(21) Appl. No.: 09/483,202

(22) Filed: Jan. 14, 2000

(30) Foreign Application Priority Data

Nov. 12, 1999 (KR) ..... 99-24754

(51) Int. Cl.[7] ..... A45D 29/00
(52) U.S. Cl. ..... 132/73
(58) Field of Search ..... 7/170, 169; 294/137; 132/73, 73.5, 75, 75.3, 76.2

(56) References Cited

U.S. PATENT DOCUMENTS 2,467,085 * 4/1949 Gildone ..... 132/73
3,584,908 * 6/1971 Ray ..... 294/1.2
4,648,416 * 3/1987 Kilman et al. ..... 132/320
4,947,876 * 8/1990 Larsen ..... 132/73
4,953,902 * 9/1990 Brown ..... 294/1.1
5,251,943 * 10/1993 Dalbo et al. ..... 294/1.1

* cited by examiner

*Primary Examiner*—Todd E. Manahan
*Assistant Examiner*—Eduardo C. Robert
(74) *Attorney, Agent, or Firm*—Lee & Hong

(57) ABSTRACT

Disclosed is an artificial fingernail attachment aid. The artificial fingernail attachment aid comprises a head part; a grip part coupled at a lower end thereof to the head part in a manner such that it is inclined by a predetermined angle with respect to the head part or extends parallel to the head part, the grip part having an upper end which is gradually decreased in its thickness to define a sharp edged portion; a cushioning member fastened to a lower surface of the head part; and a double-sided adhesive tape affixed to a lower surface of the cushioning member.

11 Claims, 5 Drawing Sheets

ARTIFICIAL FINGERNAIL ATTACHMENT AID

BACKGROUND OF THE INVENTION

1. Field of the Invention

The present invention relates to an artificial fingernail attachment aid, and more particularly, the present invention relates to an artificial fingernail attachment aid which enables an artificial fingernail to be easily and precisely attached to an upper surface of a fingernail and prevents the artificial fingernail from being broken or scratched in the course of attaching the artificial fingernail to the fingernail.

2. Description of the Related Art

Generally, women have great concern for beauty and sometimes desire longer fingernails than they naturally have, usually for fashion reasons.

Fingernail polish which enables various colors to be coated onto fingernails, is widely used for making fingernails to look beautiful. Also, in recent years, artificial fingernails onto which various colors are coated, were developed and distributed all over the world.

The artificial fingernails are divided into a variety of kinds depending upon their sizes and colors. The artificial fingernails are attached onto upper surfaces of fingernails through adhesive for fingernails, such as double-sided adhesive tapes or the like.

In other words, briefly explaining a procedure through which an artificial fingernail is attached to a fingernail, a double-sided adhesive tape, glue, etc. which is a kind of adhesive means, is first attached or applied onto the upper surface of the fingernail, and then the artificial fingernail is seated onto the desired fingernail.

When the artificial fingernail is seated onto the desired fingernail as described above, by pressing the artificial fingernail against the fingernail, the artificial fingernail is attached onto the upper surface of the fingernail through the adhesive means which is intervened between the artificial fingernail and the fingernail to serve as a medium.

However, in the case that the artificial fingernail is attached to the fingernail using fingers of the other hand of the user, several problems occur.

First, because the artificial fingernail is thin and small, difficulties exist in attaching the artificial fingernail to the fingernail.

That is to say, in order to attach the artificial fingernail to the fingernail, the artificial fingernail must be pressed against the fingernail in a state wherein the double-sided adhesive tape, adhesive, etc. is attached onto the upper surface of the fingernail or a lower surface of the artificial fingernail. In this case, since the artificial fingernail is thin and small, it is inconvenient for the user to grasp the artificial fingernail and it is difficult for the user to attach the artificial fingernail to a desired position on the fingernail. Also, when adhesive is used, due to the fact that the adhesive may cling to the user's fingers, the artificial fingernail is likely to stick to the user's fingers. As a result, a great deal of effort and time is required to precisely attach the artificial fingernail onto the upper surface of the fingernail.

Further, in the case that the artificial fingernail is attached to the fingernail using the fingers of the other hand of the user, the artificial fingernail is likely to be scratched by the user's fingers, whereby appearance of the artificial fingernail can be deteriorated.

Namely, when the artificial fingernail is attached to the fingernail, the artificial fingernail is attached to the upper surface of the fingernail in a state wherein the user grasps the artificial fingernail using the thumb and the index finger. At this time, the likelihood of the artificial fingernail to be scratched by the fingernail of the user is increased. In an extreme case, the artificial fingernail can be broken by force of the fingers which grasp the artificial fingernail. Hence, the user must pay careful attention to attach the artificial fingernail onto the fingernail.

SUMMARY OF THE INVENTION

Accordingly, the present invention has been made in an effort to solve the problems occurring in the related art, and an object of the present invention is to provide an artificial fingernail attachment aid which enables an artificial fingernail to be easily and precisely attached to an upper surface of a fingernail and prevents the artificial fingernail from being broken or scratched in the course of attaching the artificial fingernail to the fingernail.

In order to achieve the above object, according to one aspect of the present invention, there is provided an artificial fingernail attachment aid, comprising: a head part; a grip part coupled at a lower end thereof to the head part in a manner such that it is inclined by a predetermined angle with respect to the head part or extends parallel to the head part, the grip part having an upper end which is gradually decreased in its thickness to define a sharp edged portion; a cushioning member fastened to a lower surface of the head part; and a double-sided adhesive tape affixed to a lower surface of the cushioning member, the double-sided adhesive tape serving as adhesive means.

According to another aspect of the present invention, the artificial fingernail attachment aid has a bar-shaped configuration, and the adhesive means such as adhesive and the double-sided adhesive tape is stored in a state wherein it is detached from the cushioning member and is used in another state wherein it is coupled to the cushioning member.

According to another aspect of the present invention, the grip part is coupled to the head part in a manner such that it is inclined by 45° with respect to the head part to enable a user to easily attach an artificial fingernail to a fingernail; and the artificial fingernail attachment aid further comprises a cap member defining an inner space having a cross-sectional area which corresponds to that of the head part and detachably fitted around the head part in a manner such that it is brought into close contact with an outer surface of the head part, thereby to perform a function of preventing the cushioning member and the double-sided adhesive tape from being contaminated with foreign substances.

According to another aspect of the present invention, the lower surface of the cushioning member which is fastened to the lower surface of the head part, is formed in such a manner that it has a contour which corresponds to that of an upper surface of the artificial fingernail, thereby to allow the artificial fingernail to be easily attached to the double-sided adhesive tape.

According to another aspect of the present invention, the double-sided adhesive tape is directly affixed to the lower surface of the head part.

According to another aspect of the present invention, the head part is made of soft synthetic resin.

According to still another aspect of the present invention, the lower surface of the head part is processed in a manner such that it has an adhesive property by itself.

According to yet still another aspect of the present invention, the head part and the grip part are threadedly coupled to each other in such a manner that they can be detached from each other, or the head part and the grip part are coupled to each other by means of an engaging projection and an engaging groove.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
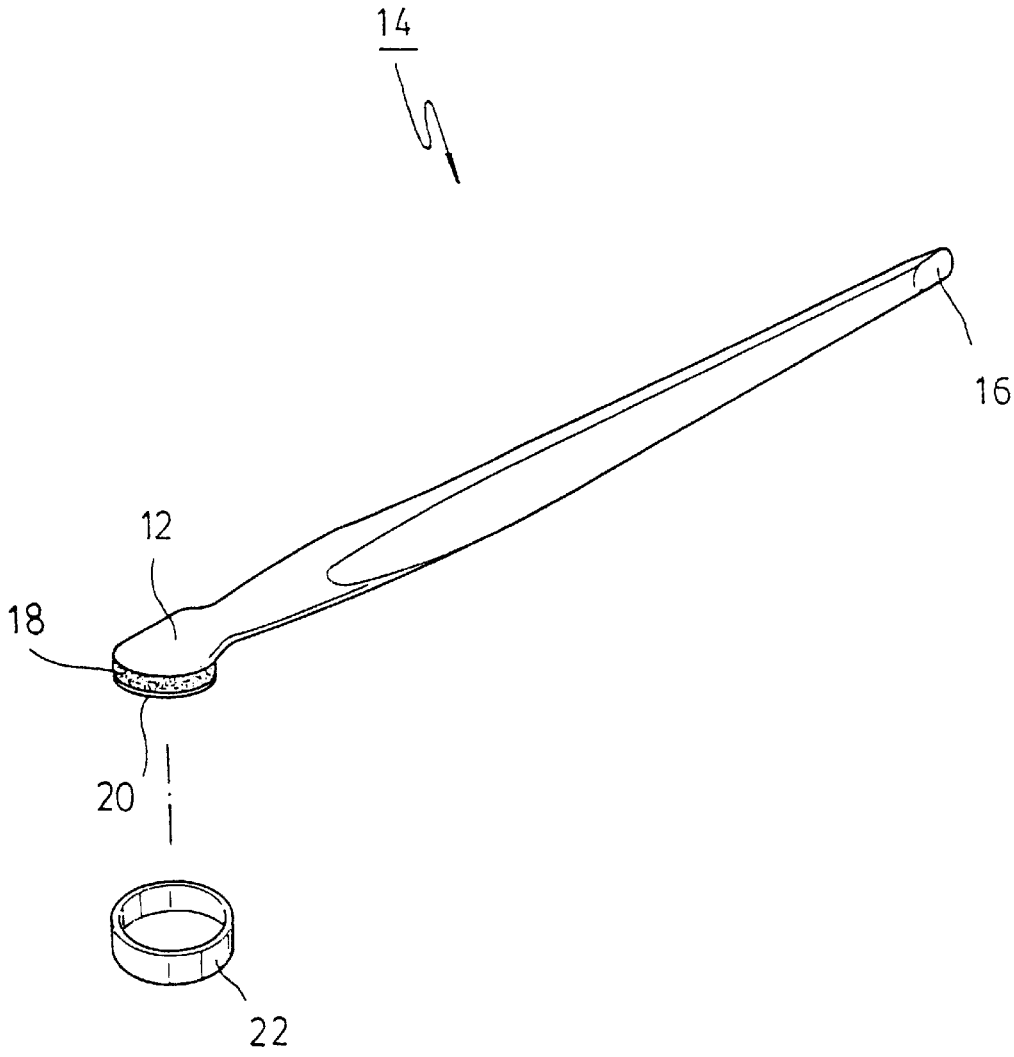
FIG. 1 is a perspective view illustrating a construction of an artificial fingernail attachment aid in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
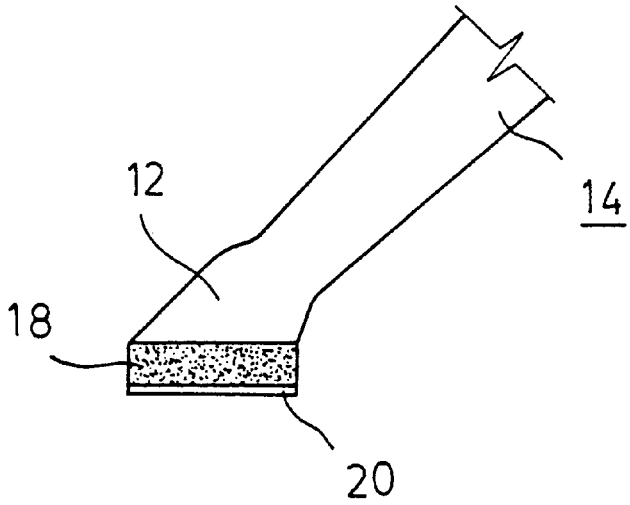
FIG. 2 is a partially enlarged front view illustrating a state wherein a cushioning member is fastened to a lower surface of a head part and then a double-sided adhesive tape is affixed to a lower surface of the cushioning member.

FIG. 1 is a perspective view illustrating a construction of an artificial fingernail attachment aid in accordance with an embodiment of the present invention, and FIG. 2 is a partially enlarged front view illustrating a state wherein a cushioning member is fastened to a lower surface of a head part and then a double-sided adhesive tape is affixed to a lower surface of the cushioning member.

Referring to FIGS. 1 and 2, the artificial fingernail attachment aid 14 according to the present invention includes a head part 12 and a grip part (not numbered) which is coupled at a lower end thereof to the head part 12. The grip part has an upper end which is gradually decreased in its thickness to define a sharp edged portion 16.

A cushioning member 18 is fastened to a lower surface of the head part 12 of the artificial fingernail attachment aid 14, and a double-sided adhesive tape 20 is affixed to a lower surface of the cushioning member 18.

It is preferred that the artificial fingernail attachment aid 14 has substantially a bar-shaped configuration. It is also preferred that the artificial fingernail attachment aid 14 is made of material which has relatively a light weight, such as synthetic resin, wood or the like, to allow a user to easily use the artificial fingernail attachment aid 14.

Further, it is preferred that the cushioning member 18 which is fastened to the lower surface of the head part 12 of the artificial fingernail attachment aid 14, is made of foamed material which can be freely contracted and expanded.

In addition, it is preferred that the grip part is coupled to the head part 12 in a manner such that the grip part is inclined by 45° with respect to the head part 12 or extends parallel to the head part 12, to enable the user to easily attach an artificial fingernail (not shown) to a fingernail.

Moreover, the artificial fingernail attachment aid 14 further includes a cap member 22 which defines an inner space having a cross-sectional area which corresponds to that of the head part 12. The cap member 22 performs a function of preventing the cushioning member 18 and the double-sided adhesive tape 20 from being contaminated with foreign substances.

Hereinafter, operations of the artificial fingernail attachment aid 14 constructed as mentioned above and effects obtained thereby will be described in detail.

In the case that the artificial fingernail is attached to the fingernail, adhesive means, for example, another double-sided adhesive tape is first attached onto an upper surface of the fingernail which is to be covered by the artificial fingernail.

When the adhesive means is attached onto the upper surface of the fingernail, the head part 12 of the artificial fingernail attachment aid 14 is forced to be brought into close contact with one of artificial fingernails which are arranged inside an artificial fingernail case (not shown).

Due to the fact that the double-sided adhesive tape 20 is affixed to the lower surface of the cushioning member 18 which in turn is fastened to the lower surface of the head part 12 of the artificial fingernail attachment aid 14, when the head part 12 of the artificial fingernail attachment aid 14 is forced to be brought into close contact with one of the artificial fingernails which are arranged inside the artificial fingernail case, the artificial fingernail is adhered to the double-sided adhesive tape 20 which is affixed to the lower surface of the cushioning member 18. At this time, since several artificial fingernails having a variety of sizes are arranged inside the artificial fingernail case, the head part 12 of the artificial fingernail attachment aid 14 is forced to be brought into close contact with the artificial fingernail having a desired size.

After the artificial fingernail is adhered to a lower end of the head part 12 by adhesive force of the double-sided adhesive tape 20, the artificial fingernail which is adhered to the lower end of the head part 12 by the adhesive force of the double-sided adhesive tape 20, is moved onto the upper surface of the fingernail.

If the artificial fingernail is moved onto the upper surface of the fingernail, by pressing the head part 12 of the artificial fingernail attachment aid 14, the artificial fingernail is fixedly attached to the fingernail.

Due to the fact that the adhesive means is attached onto the upper surface of the fingernail, if the head part 12 of the artificial fingernail attachment aid 14 is pressed against the fingernail, the artificial fingernail is fixedly and closely secured to the fingernail by the adhesive means.

When the artificial fingernail is fixedly and closely secured to the fingernail by the adhesive means, finishing work is performed using the sharp edged portion 16 which is formed on the upper end of the grip part of the artificial fingernail attachment aid 14, in a manner such that edge portions of the artificial fingernail are brought into close contact with the fingernail.

Therefore, because the upper end of the grip part of the artificial fingernail attachment aid 14 is formed such that it is gradually decreased in its thickness to define the sharp edged portion 16, it is possible to perform the finishing work in an easy manner.

Also, since the cushioning member 18 is fastened to the lower surface of the head part 12 of the artificial fingernail attachment aid 14, when the artificial fingernail is forced to be brought into close contact with the fingernail by the head part 12, shock is not transferred to the fingernail.

Moreover, because of the fact that the cap member 22 is detachably fitted around the lower end of the head part 12, the cushioning member 18 and the double-sided adhesive tape 20 are not contaminated with foreign substances.

Figure 3:
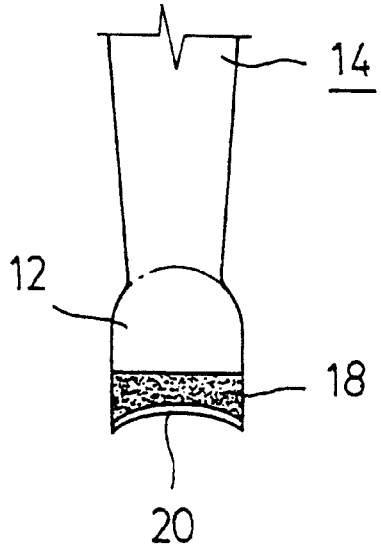
FIG. 3 is a partially enlarged side view illustrating another cushioning member in accordance with another embodiment of the present invention.

FIG. 3 is a partially enlarged side view illustrating another cushioning member in accordance with another embodiment of the present invention.

As shown in FIG. 3, the lower surface of the cushioning member 18 which is fastened to the lower surface of the head part 12, is formed in such a manner that it has a contour which corresponds to that of an upper surface of the artificial fingernail, thereby to allow the double-sided adhesive tape 20 to be easily brought into close contact with an upper surface of the artificial fingernail and thereby the artificial fingernail to be easily attached to the double-sided adhesive tape 20.

Consequently, due to the fact that the lower surface of the cushioning member 18 is formed in such a manner that it has a contour which corresponds to that of the upper surface of the artificial fingernail, the artificial fingernail can come into secure contact with the double-sided adhesive tape 20.

In other words, because an area over which a lower surface of the double-sided adhesive tape 20 and the upper surface of the artificial fingernail are brought into contact with each other, is increased, the artificial fingernail is brought into close contact with the lower surface of the double-sided adhesive tape 20 and is not willing to be released from the double-sided adhesive tape 20 even when the artificial fingernail is moved or force is applied to the artificial fingernail.

Figure 4:
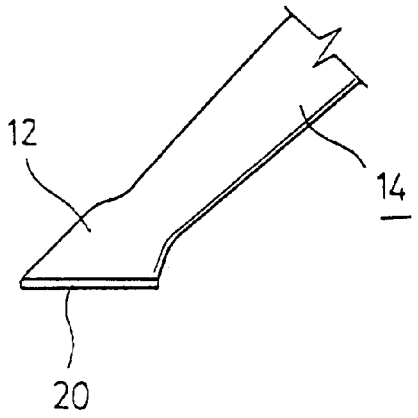
FIG. 4 is a partially enlarged front view illustrating an artificial fingernail attachment aid in accordance with another embodiment of the present invention.

FIG. 4 is a partially enlarged front view illustrating an artificial fingernail attachment aid in accordance with another embodiment of the present invention.

As shown in FIG. 4, the artificial fingernail attachment aid 14 can be used in a state wherein the double-sided adhesive tape 20 is directly affixed to the lower surface of the head part 12.

At this time, it is preferred that the head part 12 of the artificial fingernail attachment aid 14 is made of soft synthetic resin.

Figure 5:
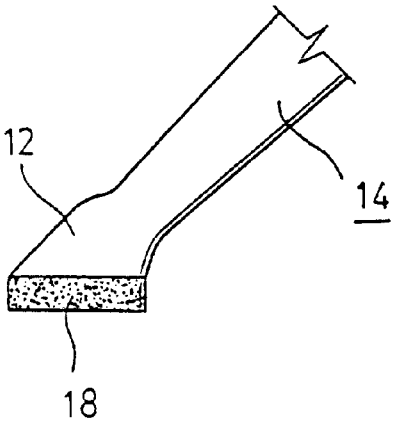
FIG. 5 is a partially enlarged front view illustrating an artificial fingernail attachment aid in accordance with another embodiment of the present invention.

FIG. 5 is a partially enlarged front view illustrating an artificial fingernail attachment aid in accordance with another embodiment of the present invention. As shown in FIG. 5, the artificial fingernail attachment aid 14 can be used in a state wherein the lower surface of the head part 12 is processed in a manner such that it has a predetermined adhesive property by itself.

Figure 6:
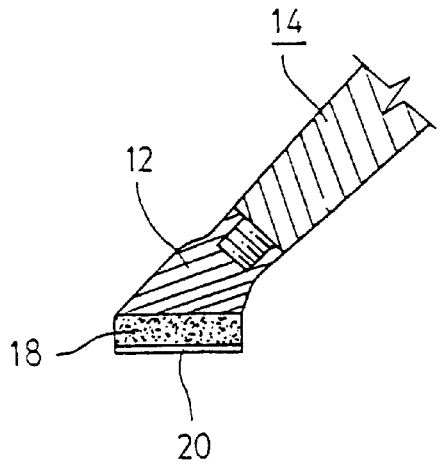
FIG. 6 is a partially enlarged cross-sectional view illustrating an artificial fingernail attachment aid in accordance with another embodiment of the present invention.

FIG. 6 is a partially enlarged cross-sectional view illustrating an artificial fingernail attachment aid in accordance with another embodiment of the present invention.

As can be readily seen from FIG. 6, because the head part 12 and the grip part of the artificial fingernail attachment aid 14 are threadedly coupled to each other in such a manner that they can be detached from each other, if functionalities of the cushioning member 18 and the double-sided adhesive tape 20 are degraded, they can be replaced with new cushioning member 18 and the double-sided adhesive tape 20, respectively.

Figure 7:
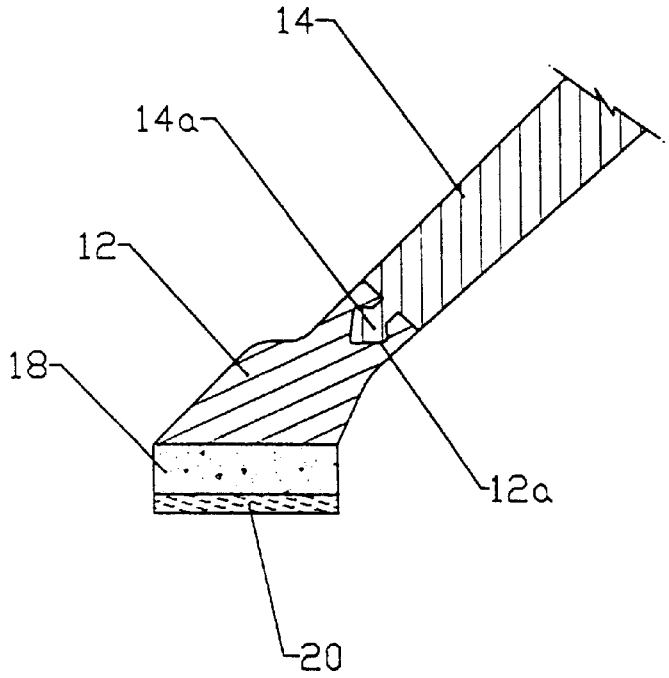
FIG. 7 is a partially enlarged cross-sectional view illustrating an artificial fingernail attachment aid in accordance with still another embodiment of the present invention.

FIG. 7 is a partially enlarged cross-sectional view illustrating an artificial fingernail attachment aid in accordance with still another embodiment of the present invention.

As shown in FIG. 7, the grip part and the head part 12 of the artificial fingernail attachment aid 14 are formed with an engaging projection 14*a* and an engaging groove 14*b*, respectively. Due to the fact that the engaging projection 14*a* is engaged into the engaging groove 14*b*, the grip part and the head part 12 of the artificial fingernail attachment aid 14 are coupled to each other. Therefore, if functionalities of the cushioning member 18 and the double-sided adhesive tape 20 are degraded, they can be replaced with a new cushioning member 18 and a new double-sided adhesive tape 20, respectively, in a convenient way.

Figure 8:
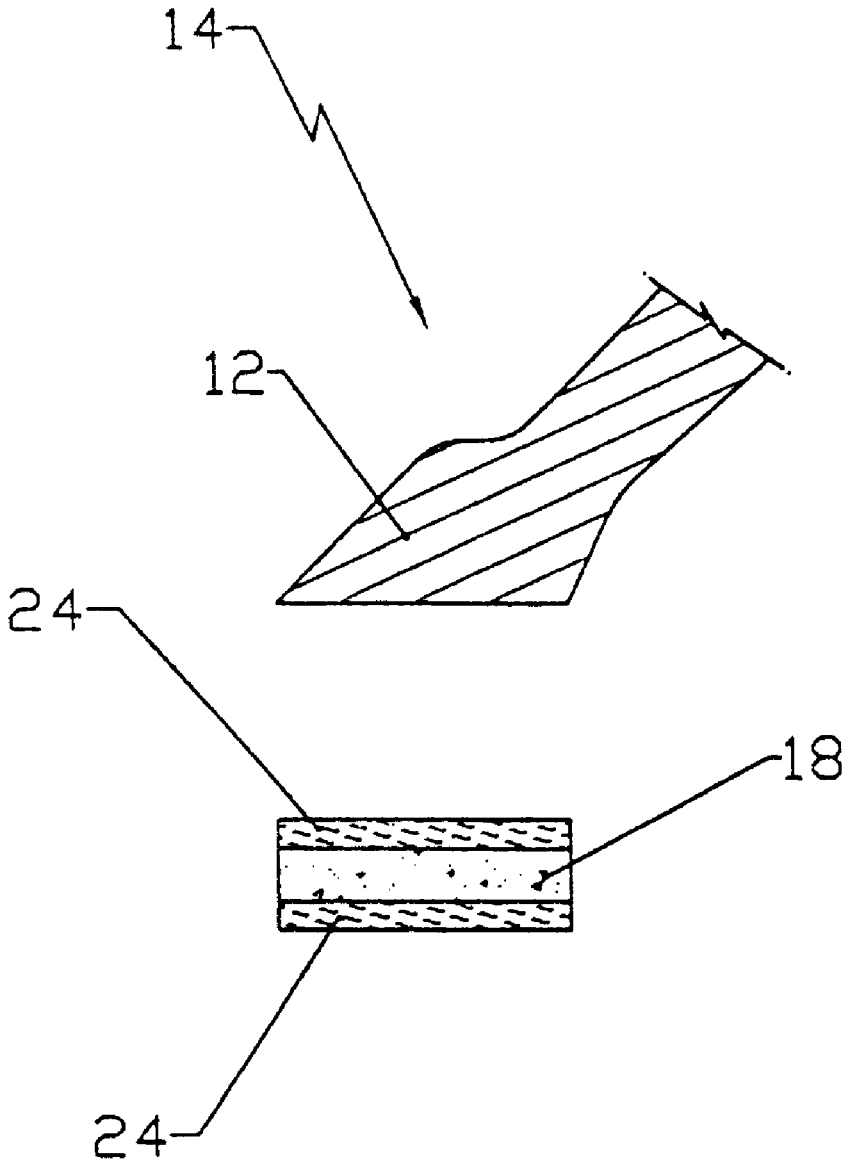
FIG. 8 is a partially enlarged view illustrating an artificial fingernail attachment aid in accordance with yet still another embodiment of the present invention.

FIG. 8 is a partially enlarged view illustrating an artificial fingernail attachment aid in accordance with yet still another embodiment of the present invention.

As shown in FIG. 8, in the above embodiment, the cushioning member 18 which has a pair of adhesive layers 24 applied to both surfaces thereof, respectively, is maintained in a state wherein it is detached from the head part 12 of the artificial fingernail attachment aid 14. In the present embodiment, when the user wishes to attach the artificial fingernail to the fingernail, the cushioning member 18 can be used in a state wherein it is directly attached to the head part 12 of the artificial fingernail attachment aid 14.

As described above, the artificial fingernail attachment aid according to the present invention, constructed as mentioned above, provides advantages in that, since a cushioning member is fastened to a lower surface of a head part and then a double-sided adhesive tape is affixed to a lower surface of the cushioning member, it is possible to easily attach an artificial fingernail to a fingernail and to prevent the artificial fingernail from being broken or scratched in the course of attaching the artificial fingernail to the fingernail.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. An artificial fingernail attachment aid, comprising:

a head part;

a grip part coupled at a lower end thereof to the head part in a manner such that it is inclined by a predetermined angle with respect to the head part or extends parallel to the head part, the grip part having an upper end which is gradually decreased in its thickness to define a sharp edged portion;

a cushioning member fastened to a lower surface of the head part; and a double-sided adhesive tape affixed to a lower surface of the cushioning member.

2. The artificial fingernail attachment aid as claimed in claim 1, wherein the artificial fingernail attachment aid has a bar-shaped configuration.

3. The artificial fingernail attachment aid as claimed in claim 1, wherein the grip part is coupled to the head part in a manner such that it is inclined by 45° with respect to the head part to enable a user to easily attach an artificial fingernail to a fingernail.

4. The artificial fingernail attachment aid as claimed in claim 1, further comprising:

a cap member defining an inner space having a cross-sectional area which corresponds to that of the head part and detachably fitted around the head part in a manner such that it is brought into close contact with an outer surface of the head part, thereby to perform a function of preventing the cushioning member and the double-sided adhesive tape from being contaminated with foreign substances.

5. The artificial fingernail attachment aid as claimed in claim 1, wherein the lower surface of the cushioning member which is fastened to the lower surface of the head part, is formed in such a manner that it has a contour which corresponds to that of an upper surface of the artificial fingernail, thereby to allow the artificial fingernail to be easily attached to the double-sided adhesive tape.

6. The artificial fingernail attachment aid as claimed in claim 1, wherein the double-sided adhesive tape is directly affixed to the lower surface of the head part.

7. The artificial fingernail attachment aid as claimed in claim 6, wherein the head part is made of soft synthetic resin.

8. The artificial fingernail attachment aid as claimed in claim 1, wherein the lower surface of the head part is processed in a manner such that it has an adhesive property by itself.

9. The artificial fingernail attachment aid as claimed in claim 1, wherein the head part and the grip part are threadedly coupled to each other in such a manner that they can be detached from each other.

10. The artificial fingernail attachment aid as claimed in claim 1, wherein the head part and the grip part are coupled to each other by means of an engaging projection and an engaging groove.

11. The artificial fingernail attachment aid as claimed in claim 1, wherein the head part and the grip part are stored in a state wherein they are detached from each other and are used in another state wherein they are coupled to each other.

* * * * *